United States Patent [19]

Blanchard et al.

[11] Patent Number: 4,917,151

[45] Date of Patent: Apr. 17, 1990

[54] FLUIDIC APPARATUS

[75] Inventors: Alan Blanchard, Preston; Lionel H. Ford, Blackpool, both of United Kingdom

[73] Assignee: United Kingdom Atomic Energy Authority, Oxfordshire, United Kingdom

[21] Appl. No.: 300,778

[22] Filed: Jan. 23, 1989

[30] Foreign Application Priority Data

Jan. 29, 1988 [GB] United Kingdom ..... 8802028

[51] Int. Cl.[4] ..... F15C 1/12

[52] U.S. Cl. ..... 137/815; 137/806; 137/810; 137/809; 137/813

[58] Field of Search ..... 137/806, 812, 810, 79, 137/815, 813, 809

[56] References Cited

U.S. PATENT DOCUMENTS

| | | | |
|---|---|---|---|
| 2,829,720 | 8/1958 | Heigis et al. | 137/79 |
| 3,000,053 | 9/1961 | Hart | 137/567 |
| 3,431,930 | 3/1969 | Bowles | 137/806 |
| 3,515,158 | 2/1970 | Utz | 137/810 |
| 3,638,672 | 2/1972 | Smith et al. | 137/813 |
| 4,126,156 | 11/1978 | Barnes | 137/810 |
| 4,542,775 | 9/1985 | Beck | 137/812 |

FOREIGN PATENT DOCUMENTS

| | | |
|---|---|---|
| 1192965 | 8/1968 | United Kingdom . |
| 1247920 | 11/1968 | United Kingdom . |
| 1227296 | 4/1969 | United Kingdom . |
| 1211788 | 11/1970 | United Kingdom . |
| 1335876 | 1/1971 | United Kingdom . |

*Primary Examiner*—A. Michael Chambers

*Attorney, Agent, or Firm*—King & Schickli

[57] ABSTRACT

A vortex amplifier having a vortex chamber is included in a fluid flow line. A sensor in the fluid flow line upstream of the vortex chamber and operable in response to changes in the fluid flow controls a valve in a further flow line for introducing a control fluid into the vortex chamber. The arrangement results in an automatic control in the fluid flow line.

11 Claims, 2 Drawing Sheets

FLUIDIC APPARATUS

BACKGROUND OF THE INVENTION

The present invention concerns fluidic apparatus.

The aim of the invention is to provide an automatic control arrangement in a fluid flow line which does not rely upon or use a conventional valve but rather uses a fluidic device known as a vortex amplifier which does not have moving parts and seals which suffer wear and corrosion during use. A vortex amplifier comprises a vortex chamber through which a main flow passes radially to emerge at an axial outlet. The main flow can be regulated and controlled by a control flow introduced tangentially into the vortex chamber.

FEATURES AND ASPECTS OF THE INVENTION

According to the present invention a fluidic apparatus comprises a fluid flow line having a vortex chamber arranged in the flow line such that fluid in the flow line enters radially into the vortex chamber and emerges axially from the chamber and a further flow line for introducing a control fluid into the chamber characterised by sensing means in the main fluid flow line upstream of the vortex chamber operable to regulate and control the supply of control fluid to the vortex chamber in response to changes in the main fluid flow.

DESCRIPTION OF THE DRAWINGS

The invention will be described further, by way of example, with reference to the accompanying drawings in which.

DESCRIPTION OF THE PREFERRED EMBODIMENTS

Figure 1:
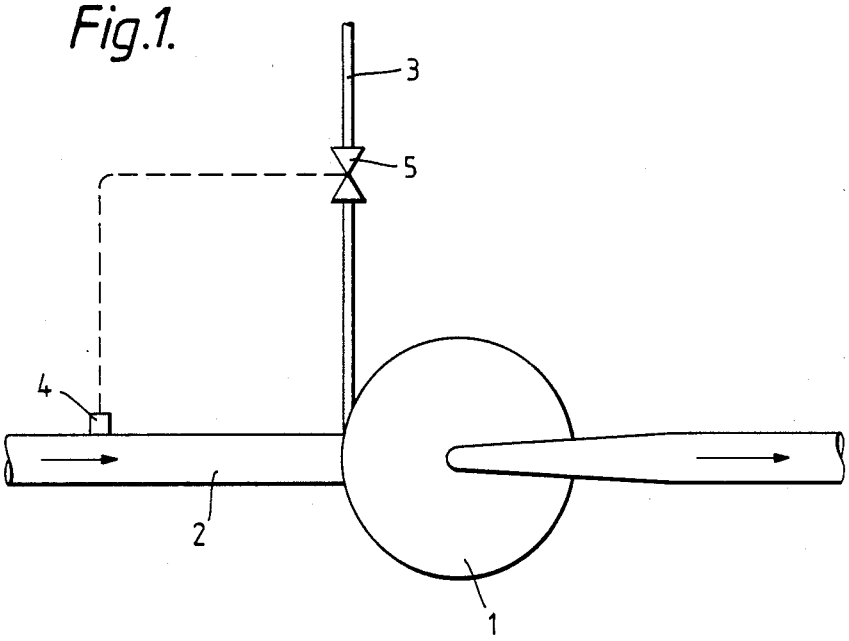
FIG. 1 is a diagrammatic representation of a first embodiment of a fluidic apparatus.

A vortex amplifier 1 is included in the fluid flow line 2, the fluid being gas or liquid. The vortex amplifier is a fluidic device having a vortex chamber with radial, axial and tangential ports. In the present arrangement the flow in line 2 enters the vortex chamber of the amplifier at the radial port and exits from the chamber at the axial port. The flow direction along the line 2 is indicated by the arrow.

A second flow line 3 communicates with the tangential port of the vortex amplifier. A flow along the line 3 into the vortex chamber can be used to control the flow along the line 2.

With no control flow along the line 3 the pressure drop through the vortex amplifier is very low and can in effect be ignored. The main flow along the line 2 can be regulated by a small control flow along the line 3. A vortex is created in the chamber of the vortex amplifier and the flow is reduced in direct proportion to the control applied along the line 3. Increasing the control flow can result in a complete cut-off of the main flow.

A detector or sensor 4 is arranged in the flow line 2 upstream of the vortex amplifier 1. The detector or sensor 4 is coupled to a control 5 in the flow line 3.

For example, the sensor 4 can be a pressure transducer which senses pressure variations in the flow line 2 upstream of the vortex amplifier and transmits signals to the control 5, which can be a valve, in the line 3. The flow in the line 3 is admitted tangentially into the vortex chamber of the vortex amplifier and by increasing the control flow the main flow along the line 2 can be progressively throttled or decreased to a minimum value or complete cut-off. Accordingly, in the above example the control flow can be regulated in response to signals received from the sensor 4 to allow the vortex amplifier to control main flow along the line 2. The control fluid in line 3 can be the same as the fluid in the line 2. Alternatively the control fluid can be different to the main flow. In many applications a suitable control fluid is compressed air. The vortex amplifier can be provided with a plurality of control ports.

Figure 2:
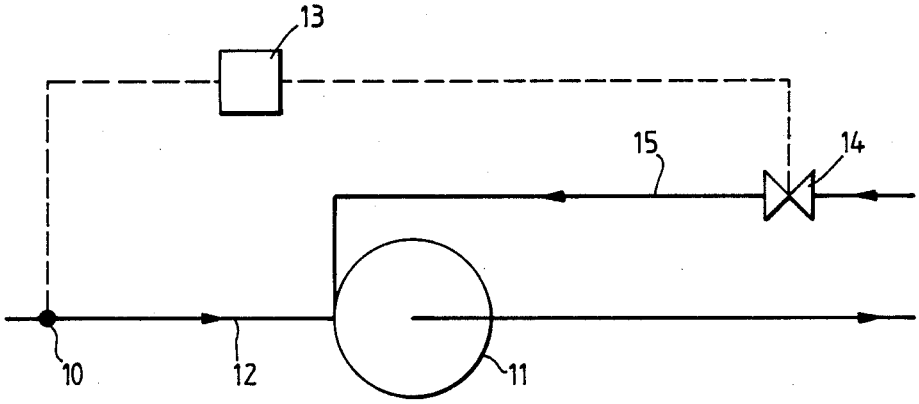
FIG. 2 is a diagram of an embodiment similar to FIG. 1.

FIG. 2 is an arrangement similar to that in FIG. 1 but showing more detail. In FIG. 2, a pressure transducer 10 capable of accurately measuring pressure in main flow line 12 at a desired position upstream of the vortex amplifier 11 provides an analogue signal output which is connected as analogue input to a programmable controller 13. The controller can comprise an electronic unit with proportional, integral and differential terms as part of its control algorithm. Within the controller the measured pressure can be compared to a desired set point pressure and should corrective action become necessary an analogue signal is set to a valve 14 in the control flow line 15. The control flow can be compressed air from a separate source and the valve modulates the flowrate of the compressed air in response to signals from the transducer 10.

The arrangement provides automatic adjustment of the flow in the fluid line and typical uses are for maintaining substantially constant pressure in ventilation ducting, glove boxes, fume cupboards, clean rooms and the like. The arrangement can be used for fire damping in a ventilation shaft or duct. Thus the sensor can be a fire or smoke detector and the control flow can automatically increase to shut off the supply thereby actinag as a damper. The control flow can be an inert gas supply.

The arrangement can also be used for mixing different fluids. The sensor can be chosen to detect a parameter of interest in the fluid flowing along the line 2. The signal from the transducer can control the valve 5 in the line 3 so that an amount of a different fluid added to the vortex chamber through the control port or ports can be varied according to some preset value. Mixing of the fluid entering the vortex amplifier along line 2 and the control fluid entering along line 3 takes place in the vortex chamber.

Figure 3:
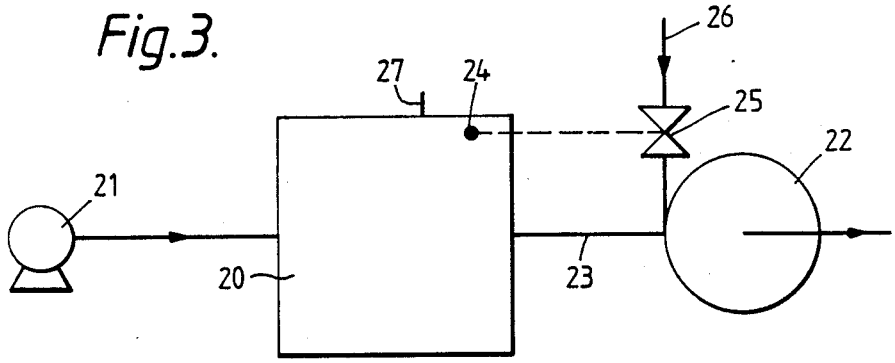
FIG. 3 is a diagram of a second embodiment.

FIG. 3 depicts an enclosed volume 20 which is to be maintained at a desired controlled positive pressure with respect to the external environment. A fan 21 blows air into the chamber and a vortex amplifier 22 is included in flow line 23 from the volume 20. A pressure sensor 24 in the volume 20 controls valve 25 in control flow line 26 to thereby provide automatic adjustment of the flow from the volume 20 along line 23 and to maintain the desired positive pressure within the volume 20. A controlled bleed inlet 27 can be provided at the volume 20.

Figure 4:
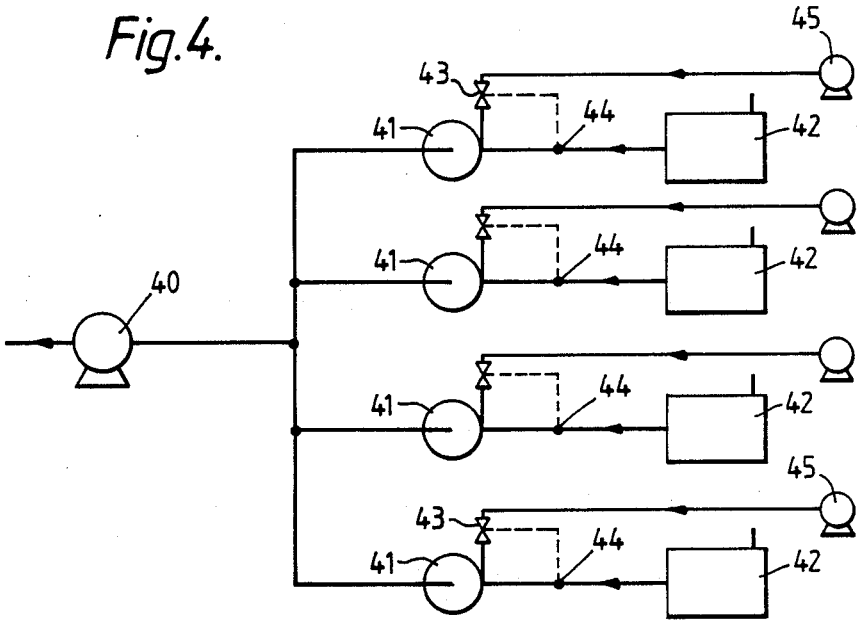
FIG. 4 is a diagram of a further embodiment.

Alternatively the fan can be provided downstream of the vortex amplifier whereby to suck air out of the volume 20 and to maintain the volume at a controlled negative pressure. FIG. 4 depicts such an arrangement in which a single fan or suction pump 40 communicates with a plurality of vortex amplifiers 41 arranged in parallel and each amplifier controlling an associated volume or chamber 42. As before, a control flow which can be compressed air is regulated by a valve 43 responsive to a transducer 44 in the flow line from the chamber. In this way it is possible to regulate and control the pressures in the individual chambers 42. For example, the chambers 42 can each be maintained at a different negative pressure by means of the single fan or suction pump 40. Although each control flow line is shown with its individual fan 45 it is possible to couple the control flow lines to a common fan or to a common source of compressed air.

In a further application the invention can be employed to control flow along a pipeline in which the flow can comprise slugs of liquid separated by gas pockets. Such a situation can arise in a pipeline from an oil or gas well in which the flow can comprise slugs of oil separated by gas pockets. The high speed of travel of the slugs can result in damage to equipment at the receiving end of the pipeline. A control flow at the vortex amplifier can slow down the slugs in the pipeline. In this case the transducer in the pipeline will be capable of detecting oil or gas slugs and applying a signal to the valve in the control flow to permit increased control flow. The vortex amplifier in effect acts as a buffer in the main flow line. The control flow can be the same as the main flow.

We claim:

1. A fluidic apparatus comprising a vortex chamber and a main fluid flow line such that fluid in the main fluid flow line enters radially into the vortex chamber and emerges axially from the vortex chamber, a further flow line for introducing a contrl fluid into the vortex chamber and sensing means in the main fluid flow line upstream of the vortex chamber operable thrugh a non-fluid connection to regulate and control the supply of control fluid to the vortex chamber in response to changes in the main fluid flow.

2. A fluidic apparatus comprising a first fluid flow line, a vortex chamber arranged in the first fluid flow line such that fluid in the first fluid flow line enters radially into the vortex chamber and emerges axially from the vortex chamber, a second flow line for introducing a control fluid into the vortex chamber, the control fluid being derived from a source separate from the flow in the first fluid flow line and sensing means in the first fluid flow line upstream of the vortex chamber operable to regulate and control the supply of control fluid to the vortex chamber in response to changes in the fluid flow in the first fluid flow line.

3. A fluidic apparatus comprising a first fluid flow line having a vortex chamber arranged in the first flow line such that fluid in the first flow line enters radially into the vortex chamber and emerges axially from the chamber, a second flow line for introducing a control fluid into the chamber, the second flow line being out of fluid connection with the first flow line, and sensing means in the first fluid flow line upstream of the vortex chamber operable to regulate and control the supply of control fluid to the vortex chamber in response to changes in the fluid flow in the first fluid flow line.

4. An apparatus according to claim 3 in which the sensing means comprises a transducer means operable to control a valve in the further flow line.

5. An apparatus according to claim 4 in which the transducer means is a pressure transducer means.

6. An apparatus according to claim 3, in which the fluid flow line includes an enclosed volume upstream of the vortex chamber and the sensing means detects changes in the enclosed volume.

7. An apparatus according to claim 6 including a glove box defining said enclosed volume.

8. An apparatus according to claim 6 including a plurality of enclosed volumes and associated vortex chambers connected to a single pump means.

9. An apparatus according to claim 6 including a fume cupboard defining said enclosed volume.

10. An apparatus according to claim 6 including a clean room defining said enclosed volume.

11. An apparatus according to claim 3 wherein diverse fluids flow through the fluid flow line and the further flow line.

* * * * *

UNITED STATES PATENT OFFICE

CERTIFICATE OF CORRECTION

Patent No. 4,917,151 Dated April 17, 1990

Inventor(s) Alan Blanchard & Lionel H. Ford

ON TITLE PAGE:

It is certified that error appears in the above-identified patent and that said Letters Patent is hereby corrected as shown below:

Assignee: United Kingdom Atomic Energy Authority

London
United Kingdom

Signed and Sealed this

Nineteenth Day of November, 1991

*Attest:*

HARRY F. MANBECK, JR.

*Attesting Officer*

*Commissioner of Patents and Trademarks*